US005244139A

United States Patent [19]

Joyce

[11] Patent Number: 5,244,139

[45] Date of Patent: Sep. 14, 1993

[54] MAGAZINE FOR LOADING FASTENERS IN UNDERPINNING MACHINES

[75] Inventor: Walter A. J. Joyce, Chorleywood, United Kingdom

[73] Assignees: Magnolia Group PLC; W. & M. Joyce Engineers, Ltd., both of United Kingdom

[21] Appl. No.: 907,397

[22] Filed: Jul. 1, 1992

[30] Foreign Application Priority Data

Jul. 3, 1991 [GB] United Kingdom ..... 9114378

[51] Int. Cl.[5] ..... B27F 7/38

[52] U.S. Cl. ..... 227/120; 227/125; 227/136; 206/340

[58] Field of Search ..... 227/120, 127, 136, 125, 227/126, 128, 176, 177; 206/230, 341, 342, 340

[56] References Cited

U.S. PATENT DOCUMENTS

| | | | |
|---|---|---|---|
| 2,296,574 | 9/1942 | Rodgers | 227/120 |
| 2,495,385 | 1/1950 | Palmer | 227/128 |
| 2,519,617 | 8/1950 | Wember | 227/133 |
| 2,520,909 | 9/1950 | Cavanagh | 227/128 |
| 2,715,220 | 8/1955 | Spencer | 227/120 |
| 3,037,207 | 6/1962 | Pazan | 227/127 X |
| 3,693,863 | 9/1972 | Black | 227/136 X |
| 3,946,927 | 3/1976 | Fehrs | 227/127 X |
| 4,369,909 | 1/1983 | Grzeika | 227/120 X |
| 4,378,065 | 3/1983 | Smirne | 206/230 |
| 4,687,098 | 8/1987 | Ebihara | 206/340 |
| 4,795,073 | 1/1989 | Yamamoto et al. | 227/120 |
| 5,009,356 | 4/1991 | Chang | 227/120 |

FOREIGN PATENT DOCUMENTS

| | | |
|---|---|---|
| 1002055 | 8/1965 | United Kingdom . |
| 2082956 | 3/1982 | United Kingdom . |
| 2148775 | 6/1985 | United Kingdom . |
| 2222546 | 3/1990 | United Kingdom . |

*Primary Examiner*—Frank T. Yost
*Assistant Examiner*—Clark F. Dexter
*Attorney, Agent, or Firm*—Basile and Hanlon

[57] ABSTRACT

A magazine for V-nails for use in underpinning of picture frames receives a strip of V-nails secured together by heat-bonded non-adhesive synthetic plastic material through an opening of greater width than the V-nails. A pusher has a downwardly projecting tongue which is driven in the machine and has depending side walls at its forward end affording a contact point for pushing the V-nails at their center of gravity towards a pair of locating formations and the extreme forward end. A single V-nail which may be presented either point foremost or point rearmost is removed from the end of the strip in the underpinning operation, the magazine being cut away and the pusher being cut away to permit this operation. On return of the drive member, a cam firstly returns the pusher to a stop in the magazine and then lifts the magazine from its operative position to enable it to be removed or refilled.

6 Claims, 3 Drawing Sheets

MAGAZINE FOR LOADING FASTENERS IN UNDERPINNING MACHINES

BACKGROUND OF THE INVENTION

1. Field of the Invention

This invention relates to a loading means for underpinning machines, for example, for the manufacture of picture frames.

2. Description of the Prior Art

Underpinning is carried out using V-shaped fixings known as V-nails or wedges, each being of thin sheet metal and having one sharp edge adapted to be driven into a frame joint by a hammer of an underpinning machine.

The V-nails are small and thin and are difficult to handle so it has been proposed to package a large number side by side in a disposable cartridge which is inserted in the underpinning machine. When the cartridge is empty, it is removed and discarded.

This procedure is wasteful but hitherto no satisfactory alternative has been proposed which enables quick and easy loading of V-nails in the correct orientation into an underpinning machine.

SUMMARY OF THE INVENTION

It is an object of the present invention to provide a new or improved loading means.

According to the invention there is provided a loading means for V-nails for use in an underpinning machine. The loading means comprises a re-usable magazine adapted to be inserted in the underpinning machine and constructed and arranged to hold a plurality of V-nails in side-by-side array. At least part of the magazine has an upper opening of greater width than the V-nails whereby they can be inserted into the magazine. The forward end of the magazine has an opening in its upper and lower faces through which a single V-nail can be removed in the direction of the axis of symmetry of the V-nail in an underpinning operation. The rear end of the magazine includes stop means. The magazine further includes a pusher means movable along the magazine from a rearward end thereof and adapted to push the V-nails towards the forward end. The pusher means includes a downwardly projecting tongue towards its forward end adapted to engage an external drive means and a downwardly extending cam towards its rearward end adapted to return the pusher means to the stop means and then to lift the magazine on return movement of the drive means.

Another aspect of the invention is to provide V-nails in a convenient form for the loading means described above. According to this aspect, the invention provides, for use in a loading means as set out above, a strip of V-nails releasably secured together in a side-by-side array by means of a localized strip of heat bonded, non-adhesive synthetic plastic material.

BRIEF DESCRIPTION OF THE DRAWINGS

A magazine embodying the invention together with a strip of V-nails embodying the invention will now be described in more detail by way of example only with reference to the accompanying drawings in which.

DETAILED DESCRIPTION OF THE PREFERRED EMBODIMENT

Figure 1:
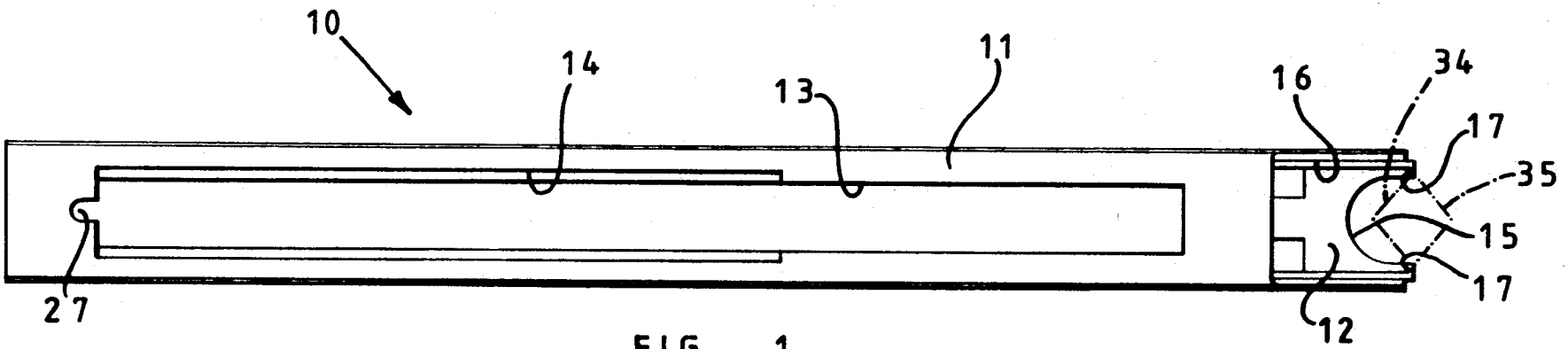
FIG. 1 is a plan view of a magazine of the loading means of an underpinning machine.

The magazine shown in the drawings is intended for use with a strip of V-nails releasably secured in a side-by-side array. While this may be done by various methods, it has been found that the use of a localized strip of heat bonded, non-adhesive synthetic plastic material is greatly preferred since it enables the V-nails to be driven individually without difficulty and also prevents the build-up of adhesive on the underpinning machine hammer, the magazine or the frame.

The magazine 10 comprises a rectangular cross-section assembly having a top member 11 and a bottom member 12. These are fitted together and spot welded to form a tubular assembly having, in its upper surface, an elongate opening 13. The rearward portion 14 of the opening 13 is enlarged to a width slightly greater than the width of a V-nail 34 so as to enable a strip of V-nails to be inserted through this portion of the magazine 10 and slid to the forward end thereof. The forward end has a through opening including an arcuate cut-out 15 in the lower member 12 and a larger rectangular opening 16 in the upper member 11 so that a hammer of an underpinning machine can strike a single V-nail at the extreme free end of the magazine 10 and drive it into position in an underpinning operation. A very small in-turned retaining lip 17 is provided as a locating formation at each side of the operative forward end of the magazine 10 so as to prevent the V-nail strip from falling through the cut-out and opening 15, 16 when in use.

Figure 2:
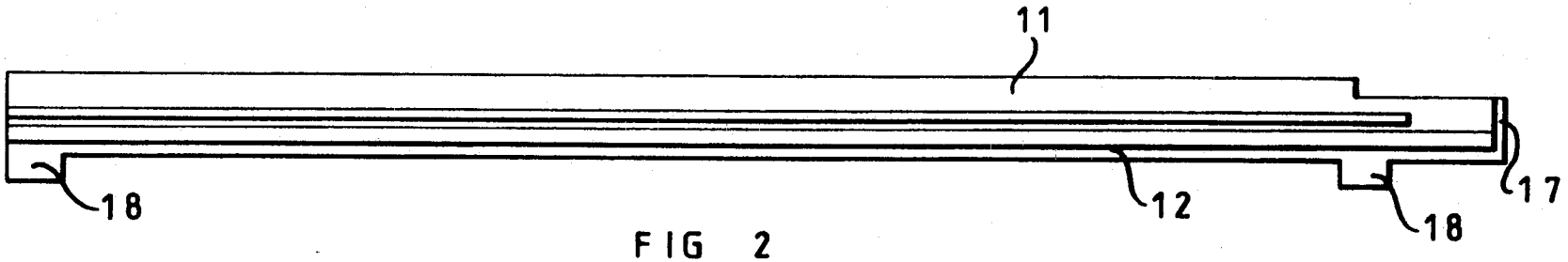
FIG. 2 is a side elevational view of the magazine of FIG. 1.
Figure 3:
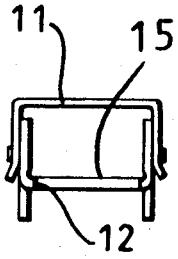
FIG. 3 is an end elevational view of the magazine of FIG. 1.

V-nails vary in size, that is, in vertical height, and it is therefore necessary to provide a magazine for a specific height of a V-nail. In the form shown in FIGS. 1–3, relatively shallow V-nails are to be housed and a pair of small downwardly depending lugs 18 are provided at the front and rear ends of the magazine 10 to enable it to be lodged in a standard underpinning machine. Where the depth of the V-nail is greater, the depth of the lower part 12 of the magazine is increased and there is no need to provide the lugs 18 for the largest size.

Figure 4:
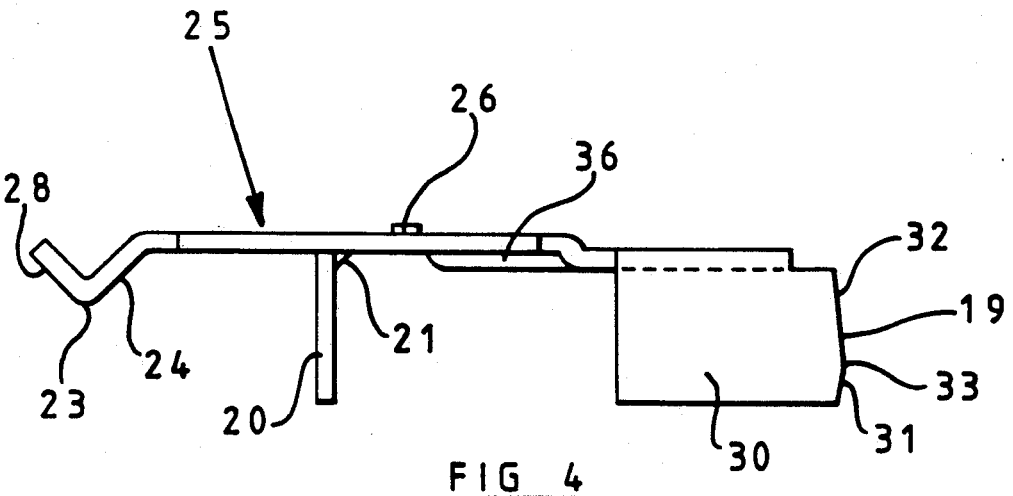
FIG. 4 is a plan view of a pusher, drawn to an enlarged scale.
Figure 5:
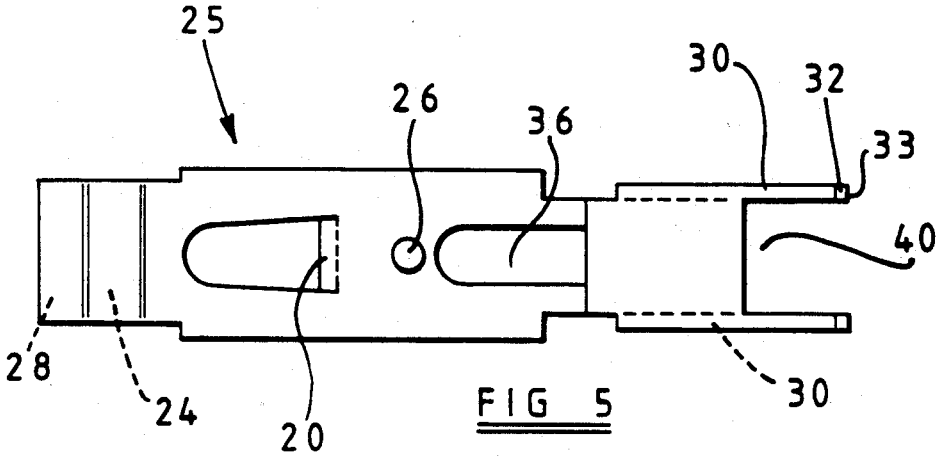
FIG. 5 is a longitudinal cross sectional view of the pusher of FIG. 4.
Figure 6:
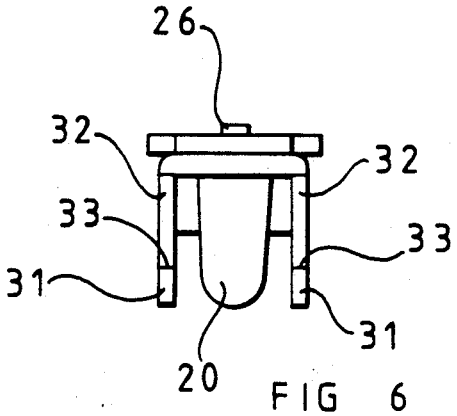
FIG. 6 is an end elevational view of the pusher of FIGS. 4 and 5.

The V-nails are pushed towards the operative forward end, that is, to the right-hand end, as shown in the drawings, by means of a pusher 25 shown in FIGS. 4–6. The pusher 25 comprises a generally U-shaped metal inverted channel portion 40 which is held captive in and is slidable in the tubular magazine 10. The forward ends of the walls 30 of the pusher 25 form pushing edges 19 which abut the strip of V-nails in use. A portion of the blank is turned down to form a depending tongue 20 in the finished pusher 25, supported by a reinforced corner 21. The pusher 25 can be made of different depths by cropping the blank to produce side walls 30 of an appropriate depth. A small chamfer 31 is provided at an angle of approximately 15° in the lower part of the side walls 30 and a similar chamfer 32 is provided at the upper part of the side walls. The chamfer 31 is of constant height irrespective of the depth of the side walls so that the point 33 bears on the center of gravity of the upstanding V-nails in the strip to ensure smooth pushing. Towards the rearward end of the pusher 25, a cam 23 is provided.

Figure 7:
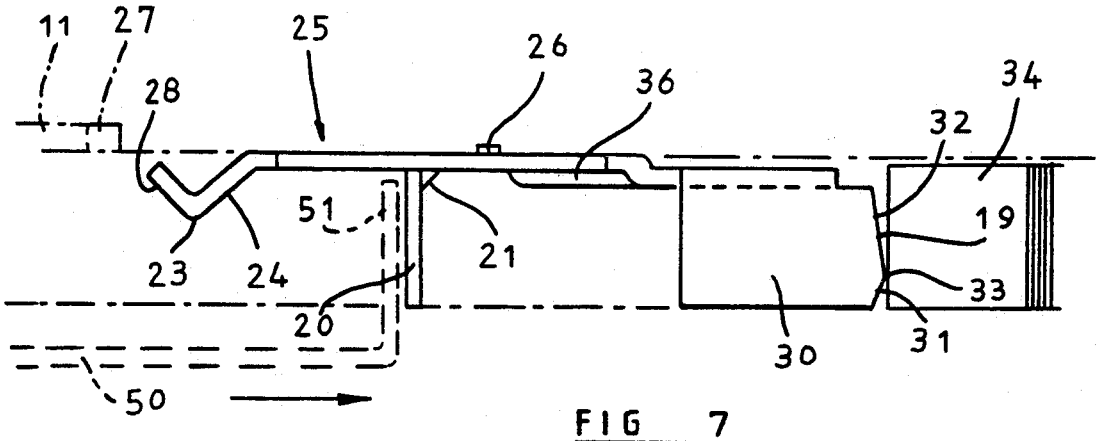
FIG. 7 is a part sectioned assembled view of the magazine and pusher when in use.

In a conventional underpinning machine, a drive member 50 is pushed forwardly towards the underpinning head so as to move a plurality of V-nails forwardly to be used. The drive member has an upstanding pin 51. This conventional drive member is utilized with the magazine described above as illustrated in FIGS. 7 to 9. As shown in FIG. 7, the pin 51 bears on the rearward face of the tongue 20 and pushes the pusher 25 forwardly in the tubular magazine 10, thereby pushing the V-nails towards the operative end and the discharge opening 15, 16.

Thus, in normal operation, the V-nails are fed from the magazine in a way similar to that used for the feeding of V-nails in the conventional disposable cartridge. However, it is necessary firstly to be able to remove the magazine and secondly to be able to re-load it. Loading has previously been described by inserting the strip of V-nails through the enlarged opening 14 in the top member 11. In order to do this, the magazine 10 need not be removed from the machine.

Figure 8:
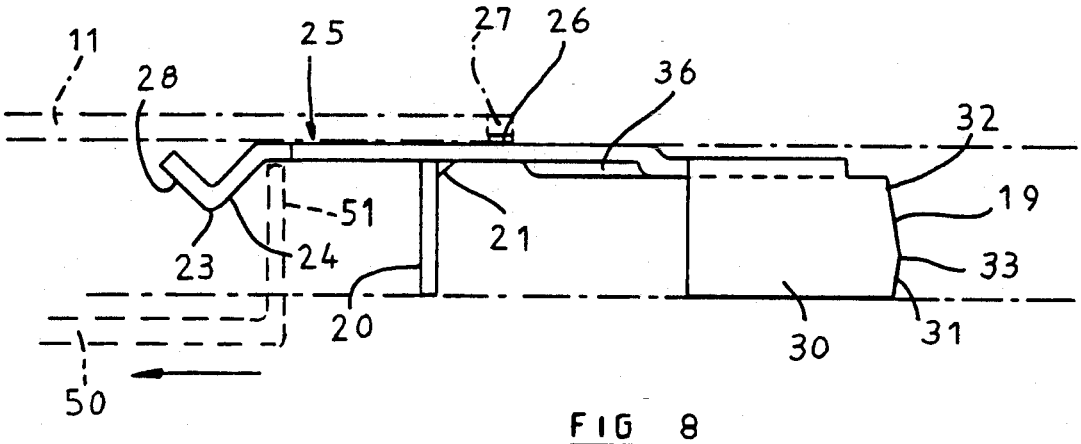
FIG. 8 is a view similar to FIG. 7 when the magazine is being withdrawn.
Figure 9:
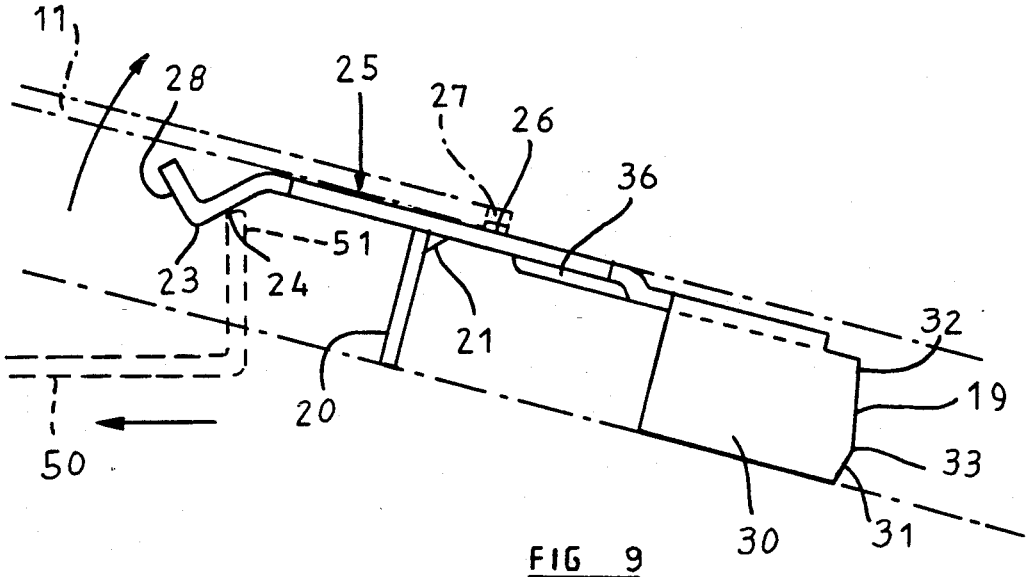
FIG. 9 is a view similar to FIGS. 7 and 8 when the magazine is fully withdrawn.

When all the V-nails have been inserted, the drive member 50 is manually withdrawn as shown in FIG. 8. Initially, the upstanding pin 51 engages against a first cam face 24 of the cam 23 and draws the pusher 25 rearwardly. When it reaches the rearward end of the magazine, an upstanding stud 26 on the upper surface engages a cut-out 27 on a bridging member of the top member 11 of the magazine and prevents further travel, holding the pusher 25 captive. As the drive member is further withdrawn, as shown in FIG. 9, the pin 51 rides along the cam surface 24 and lifts the magazine 10 to an upwardly tilted condition. In this condition, it can be manually grasped and pulled from the machine.

Once the magazine 10 has been re-loaded, or an alternative magazine 10 has been prepared if there is to be change of type of V-nails to be used, the magazine 10 is inserted into the machine and allowed to drop fully into the horizontal operative condition. The sequence of events shown in FIGS. 7 to 9 is reversed. When the drive member 50 is operated, the pin 51 comes into abutment with the tongue 20. As the movement of the drive member is obstructed by the magazine 10 lying horizontally, the pin firstly contacts the other cam face 28 and lifts the magazine 10 to a tilted condition until the pin 51 can pass the cam 23. The magazine 10 then drops to the horizontal condition and the pin moves forwardly to abut the tongue 20. Thereafter, the pin pushes the pusher 25 forwardly and hence brings the V-nails into operative condition.

It will be seen from FIG. 1 that the V-nails can be fed either point foremost or wings foremost as indicated in dotted lines at reference numbers 34 and 35. This enables the magazine 10 to be used with an underpinning machine having multiple underpinning heads.

A dimple 36 is formed in the top surface of the pusher simply to render it captive within the body of the magazine 10.

It will be appreciated that the use of a loading means embodying the invention greatly reduces the wastage currently taking place because of the use of single use cartridges. The magazine can be substituted directly for a conventional cartridge without modification of the machine or the drive arrangements. By the use of a strip of V-nails releasably secured together by heat bonded, non-adhesive synthetic plastic material, loading of the magazine is straightforward.

I claim:

1. A loading means for V-nails for use in an underpinning machine, the loading means comprising:

a re-usable magazine adapted to be inserted in the underpinning machine, the magazine devised to hold a plurality of V-nails in side by side array, at least part of the magazine having an upper opening of greater width than the V-nails whereby the V-nails can be inserted into the magazine, a forward end of the magazine having an opening in its upper and lower faces through which a single V-nail can be removed in an axial direction of the V-nail in an underpinning operation, a rearward end of the magazine including a stop, the magazine further including a pusher means, pushable in and along the magazine from the rearward end thereof for pushing the V-nails towards the forward end, the pusher means including an inverted channel section at a forward end thereof, a downwardly extending cam at a rearward end thereof adapted to engage an external drive member on a return movement of the drive member to return the pusher means to the stop and then to lift the magazine. and a downwardly projecting tongue at a mid-portion thereof between said cam and said channel section adapted to engage the drive member on a forward movement of the drive member to move the pusher means towards the forward end of the magazine.

2. The loading means according to claim 1 wherein the channel section has downwardly depending side walls, each side wall having a pushing edge at a forward end thereof adapted to engage the V-nails.

3. The loading means according to claim 2 wherein the pushing edge of each side wall is chamfered to provide a pushing contact point corresponding to a center of gravity of the V-nails.

4. The loading means according to claim 2 wherein the opening in the lower face of the magazine is a cut-out between the side walls sized to permit passage of an underpinning machine hammer therethrough.

5. The loading means according to claim 1 wherein the magazine has a pair of locating formations at the extreme forward end thereof which provide means in cooperation with the pusher means to hold a single V-nail which is to be removed in an underpinning operation.

6. The loading means according to claim 1 wherein the magazine has means to accept a strip of V-nails irrespective of the orientation of the V-nails in the strip.

* * * * *